US006019352A

United States Patent [19]

Mayer

[11] Patent Number: 6,019,352

[45] Date of Patent: Feb. 1, 2000

[54] VICE LIKE GRIP FOR CHAINS

[76] Inventor: Robert Mayer, 814 Lake Borgne Ct., Slidell, La. 70461

[21] Appl. No.: 09/244,545

[22] Filed: Feb. 3, 1999

[51] Int. Cl.[7] ..... B21F 9/00

[52] U.S. Cl. ..... 254/248; 254/256; 81/370; 81/421; 269/6

[58] Field of Search ..... 254/245, 246, 254/248, 249, 256; 81/370, 424.5, 426.5, 421, 422, 423, 18.1; 269/6; 29/268

[56] References Cited

U.S. PATENT DOCUMENTS

| | | | |
|---|---|---|---|
| 335,694 | 2/1886 | Hall | 81/422 |
| 499,307 | 6/1893 | McKinney | 254/248 |
| 730,641 | 6/1903 | Hall | 254/249 |
| 826,006 | 7/1906 | Wright | 254/249 |
| 1,490,019 | 4/1924 | Neumaier | 81/422 |
| 3,647,186 | 3/1972 | Hartmann | 254/248 |
| 3,675,897 | 7/1972 | Smith | 254/256 |
| 4,157,594 | 6/1979 | Raabe | 29/268 X |
| 5,193,336 | 3/1993 | King | 81/426.5 X |
| 5,813,297 | 9/1998 | Zepkowski | 81/426.5 |
| 5,899,125 | 5/1999 | Hegemier | 81/370 |

*Primary Examiner*—Donald P. Walsh
*Assistant Examiner*—Emmanuel M. Marcelo

[57] ABSTRACT

A vice like grip for chains comprised of an elongated main handle. A pivoting jaw portion is pivotally coupled with the elongated main handle. The device includes a pair of gripping elements. One of the gripping elements is secured to the elongated main handle. Another gripping element is secured to the pivoting jaw portion. Each of the gripping elements has an inwardly extending point on a distal end thereof and a pair of curved recesses formed on proximal ends thereof

1 Claim, 2 Drawing Sheets

VICE LIKE GRIP FOR CHAINS

BACKGROUND OF THE INVENTION

1. Field of the Invention

The present invention relates to a vice like grip for chains and more particularly pertains to gripping two ends of a chain to squeeze together tight enough to fit a master link in place with a vice grip for chains.

2. Description of the Prior Art

The use of locking pliers is known in the prior art. More specifically, locking pliers heretofore devised and utilized for the purpose of locking objects in place are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,305,669 to Kimbro et al. discloses a shaft clamping pliers.

U.S. Pat. No. 4,751,862 to Winfrey discloses jaw means for toggle actuated compression clamping tool.

U.S. Pat. No. 5,033,338 to Ford, Jr. discloses a self-locking device.

U.S. Pat. No. Des. 342,877 to Adamic discloses the ornamental design for locking pliers.

U.S. Pat. No. 3,606,806 to Patrick discloses pliers.

U.S. Pat. No. 5,233,893 to Schmidt discloses a safety plier type toggle wrench.

Lastly, other U.S. Pat. Nos. of interest include 1,041,826 to MacDill; U.S. Pat. No. 2,853,910 to Petersen; U.S. Pat. No. 4,157,594 to Raabe and U.S. Pat. No. 4,297,756 to Lance.

While these devices fulfill their respective, particular objective and requirements, the aforementioned patents do not describe a vice grip for chains for gripping two ends of a chain to squeeze together tight enough to fit a master link in place.

In this respect, the vice grip for chains according to the present invention substantially departs from the conventional concepts and designs of the prior art, and in doing so provides an apparatus primarily developed for the purpose of gripping two ends of a chain to squeeze together tight enough to fit a master link in place.

Therefore, it can be appreciated that there exists a continuing need for new and improved vice grip for chains which can be used for gripping two ends of a chain to squeeze together tight enough to fit a master link in place. In this regard, the present invention substantially fulfills this need.

SUMMARY OF THE INVENTION

In the view of the foregoing disadvantages inherent in the known types of locking pliers now present in the prior art, the present invention provides an improved vice grip for chains. As such, the general purpose of the present invention, which will be described subsequently in greater detail, is to provide a new and improved vice grip for chains and method which has all the advantages of the prior art and none of the disadvantages.

The jaw portion has an outwardly extending portion. A pivoting jaw portion has a first end pivotally coupled with the outwardly extending portion of the elongated main handle. The pivoting jaw portion has an outwardly extending portion. The device includes a pair of gripping elements.

One of the gripping elements is secured to the jaw portion of the elongated main handle. Another gripping element is secured to a second end of the pivoting jaw portion. Each of the gripping elements has an inwardly extending point on a distal end thereof and a pair of curved recesses formed on proximal ends thereof. A first handle has a first end pivotally coupled with the outwardly extending portion of the pivoting jaw portion. A toggle link has a first end pivotally coupled with the first handle adjacent to the first end thereof A second end extends inwardly of the hollow handle portion of the elongated main handle. A second handle is pivotally secured to the toggle link at an intermediate portion thereof. An adjustment screw extends inwardly of the hollow handle portion of the elongated main handle. The adjustment screw has an abutting distal end. The abutting distal end cooperates with the second end of the toggle link. The adjustment screw has a cross bar extending therethrough in an orthogonal relationship.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved vice grip for chains which has all the advantages of the prior art locking pliers and none of the disadvantages.

It is another object of the present invention to provide a new and improved vice grip for chains which may be easily and efficiently manufactured and marketed.

It is a further object of the present invention to provide a new and improved vice grip for chains which is of durable and reliable construction.

An even further object of the present invention is to provide a new and improved vice grip for chains which is susceptible of a low cost of manufacture with regard to both materials and labor, and which accordingly is then susceptible of low prices of sale to the consuming public, thereby making such a vice grip for chains economically available to the buying public.

Still yet another object of the present invention is to provide a new and improved vice grip for chains which provides in the apparatuses and methods of the prior art some of the advantages thereof, while simultaneously overcoming some of the disadvantages normally associated therewith.

Even still another object of the present invention is to provide a new and improved vice grip for chains for gripping two ends of a chain to squeeze together tight enough to fit a master link in place.

Lastly, it is an object of the present invention to provide a new and improved vice grip for chains comprised of an elongated main handle. A pivoting jaw portion is pivotally coupled with the elongated main handle. The device includes a pair of gripping elements. One of the gripping elements is secured to the elongated main handle. Another gripping element is secured to the pivoting jaw portion. Each of the gripping elements has an inwardly extending point on a distal end thereof and a pair of curved recesses formed on proximal ends thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
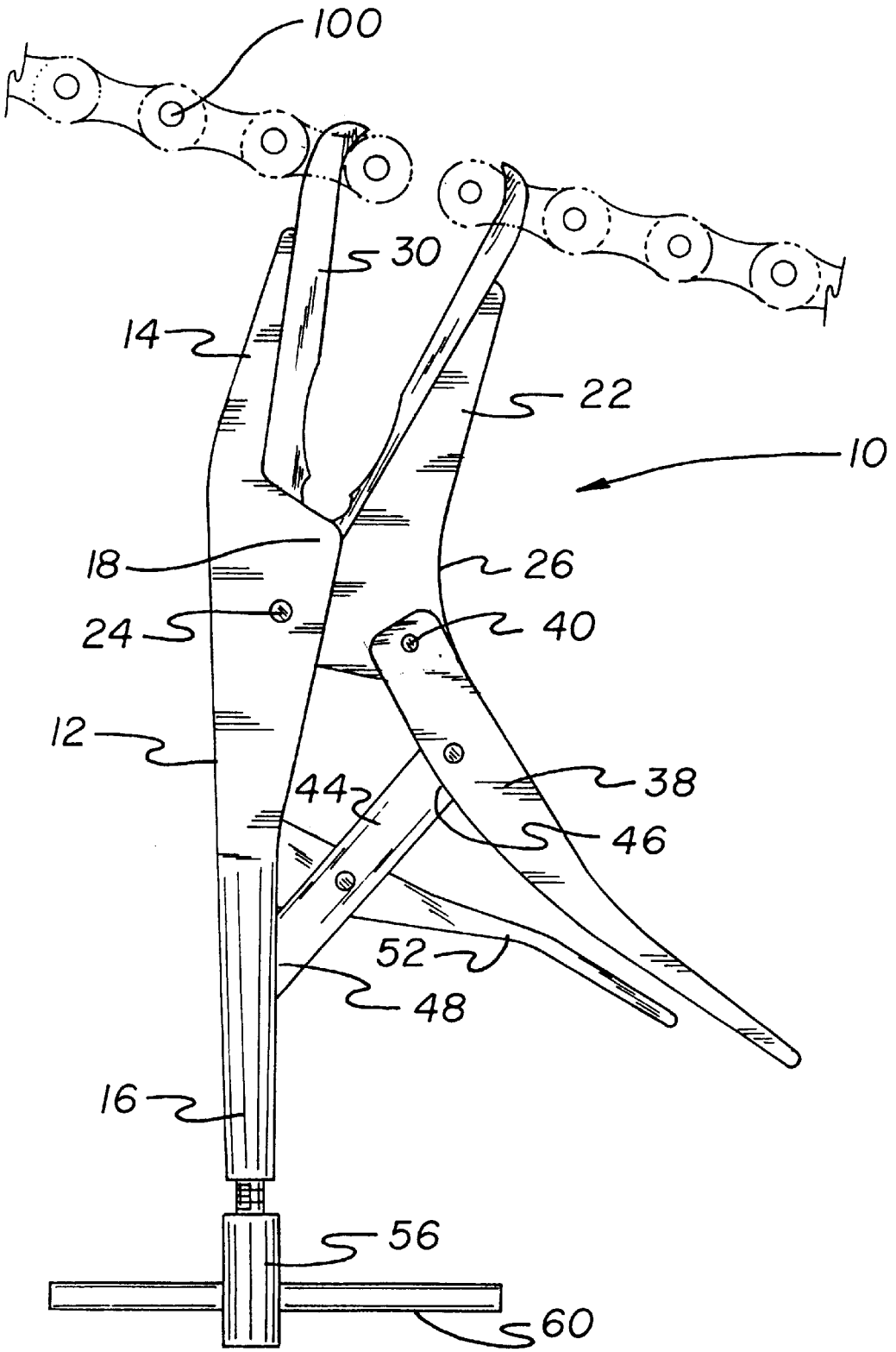
FIG. 1 is a front view of the preferred embodiment of the vice grip for chains constructed in accordance with the principles of the present invention.
Figure 2:
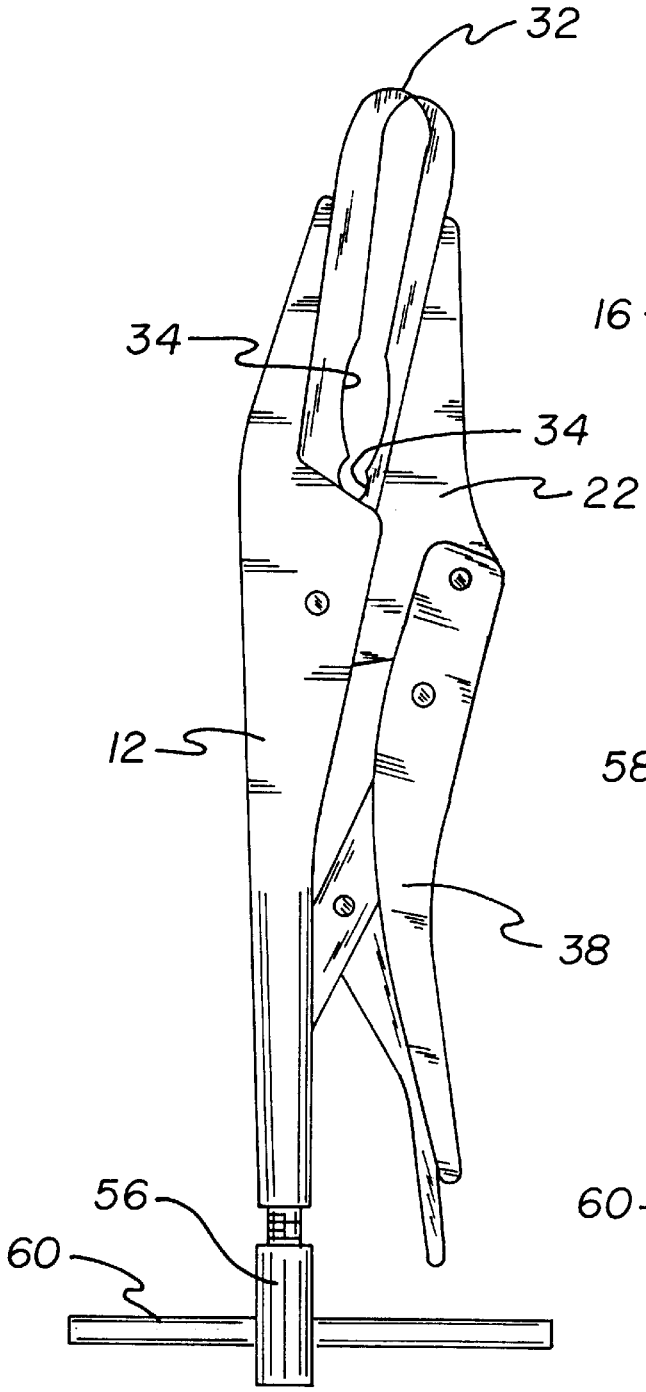
FIG. 2 is a front view of the present invention in a locked configuration.
Figure 3:
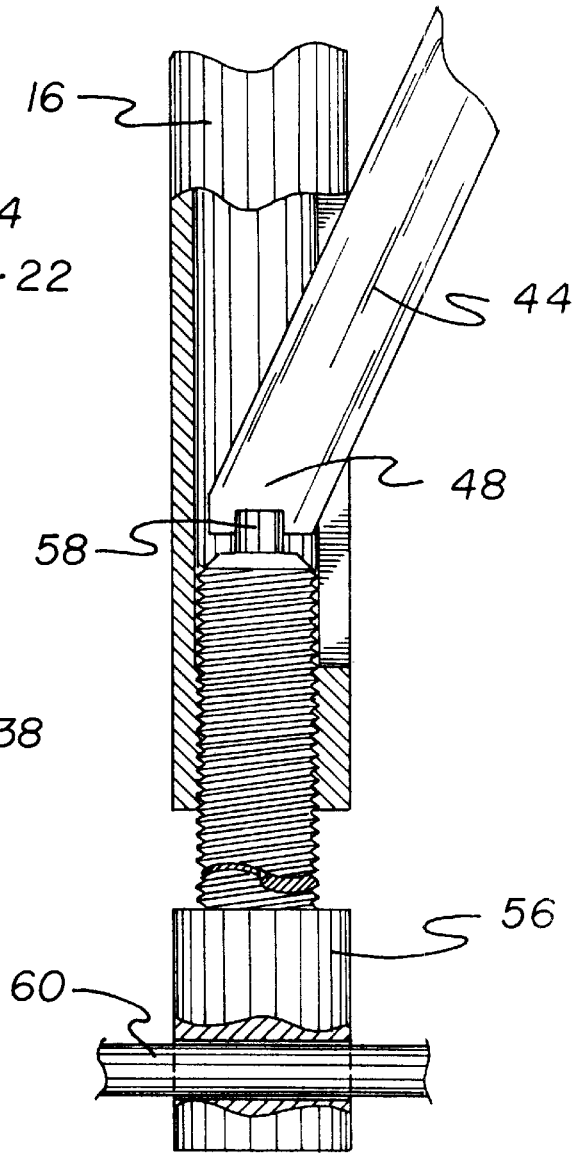
FIG. 3 is a cross-sectional view of the present invention illustrating the adjusting screw coupled with the toggle link.

With reference now to the drawings, and in particular, to FIGS. 1–3 thereof, the preferred embodiment of the new and improved vice grip for chains embodying the principles and concepts of the present invention and generally designated by the reference number 10 will be described.

Specifically, it will be noted in the various Figures that the device relates to a new and improved vice grip for chains for gripping two ends of a chain to squeeze together tight enough to fit a master link in place. In its broadest context, the device consists of an elongated main handle, a pivoting jaw portion, a pair of gripping elements, a first handle, a toggle link, a second handle, and an adjustment screw. Such components are individually configured and correlated with respect to each other so as to attain the desired objective.

The device 10 includes an elongated main handle 12 having a jaw portion 14 and a hollow handle portion 16. The jaw portion 14 has an outwardly extending portion 18.

A pivoting jaw portion 22 has a first end pivotally coupled with the outwardly extending portion 18 of the elongated main handle 12. The pivoting jaw portion 22 is pivotally coupled with the elongated main handle 12 by a pivot pin 24. The pivoting jaw portion 22 is pivoted at a point where it will pivot toward or away from the jaw portion 14 of the main handle 12 to vary the opening between the pivoting jaw portion 22 and the jaw portion 14 of the main handle 12. The pivoting jaw portion 22 has an outwardly extending portion 26.

The device 10 includes a pair of gripping elements 30. One of the gripping elements 30 is secured to the jaw portion 14 of the elongated main handle 12. Another gripping element 30 is secured to a second end of the pivoting jaw portion 22. Each of the gripping elements 30 has an inwardly extending point 32 on a distal end thereof and a pair of curved recesses 34 formed on proximal ends thereof The point is formed by a gradually inward curved. The pair of curved recesses include an uppermost recess having a width greater than a lowermost recess thereof The pair of gripping elements each have an elongated intermediate extent disposed between the pair of curved recesses and the inward curve thereof The elongated intermediate extent has a length at least three times longer than the inward curve and greater than a combined length of the pair of curved recesses. The inwardly extending points 32 on the gripping elements 30 allow for a pair of chain links 100 to be gripped safely to allow from a master link to be put in place around the pair of chain links 100.

A first handle 38 has a first end pivotally coupled with the outwardly extending portion 26 of the pivoting jaw portion 22. The first handle 38 is connected to the pivoting jaw portion 22 by a pivot pin 40. The first handle 38 manipulates the movement of the pivoting jaw portion 22.

A toggle link 44 has a first end 46 pivotally coupled with the first handle 38 adjacent to the first end thereof A second end 48 extends inwardly of the hollow handle portion 16 of the elongated main handle 12. The second end 48 is slidably received within the hollow handle portion 16. The toggle link 44 cooperates with the first handle 38 to vary the opening between the pivoting jaw portion 22 and the jaw portion 14 of the elongated main handle 12.

A second handle 52 is pivotally secured to the toggle link 44 at an intermediate portion thereof. The second handle 52 provides balance to the user manipulating the device 10.

An adjustment screw 56 extends inwardly of the hollow handle portion 16 of the elongated main handle 12. The adjustment screw 56 moves on the longitudinal axis of the elongated main handle 12. The adjustment screw 56 has an abutting distal end 58. The abutting distal end 58 cooperates with the second end 48 of the toggle link 44. The adjustment screw 56 has a cross bar 60 extending therethrough in an orthogonal relationship. Once the desired grip is attained by the jaw portion 14 of the elongated main handle 12 and the pivoting jaw portion 22, the adjustment screw 56 is tightened so that the abutting distal end 58 locks together with the second end 48 of the toggle link 44 to lock the device 10 around the chain links 100 so that a master link can be properly attached. The cross bar 60 provides added leverage to the adjustment screw 56 otherwise absent from conventional vice grips.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A vice like grip for chains for gripping two ends of a chain to squeeze together tight enough to fit a master link in place comprising, in combination:

an elongated main handle having a jaw portion and a hollow handle portion, the jaw portion having an outwardly extending portion;

a pivoting jaw portion having a first end pivotally coupled with the outwardly extending portion of the elongated main handle, the pivoting jaw portion having an outwardly extending portion;

a pair of gripping elements, one of the gripping elements secured to the jaw portion of the elongated main handle, another gripping element secured to a second end of the pivoting jaw portion, each of the gripping elements having an inwardly extending point on a distal end thereof formed by a gradually inward curved of the gripping elements and a pair of curved recesses formed on proximal ends thereof adjacent to a pivot point of the elongated main handle and the pivoting jaw portion, an uppermost recess of each gripping element has a width greater than a lowermost recess of each gripping element, the pair of gripping elements each having an elongated intermediate extent disposed between the pair of curved recesses and the inward curve thereof, the elongated intermediate extent having a length at least three times longer than the inward curve and greater than a combined length of the pair of curved recesses;

a first handle having a first end pivotally coupled with the outwardly extending portion of the pivoting jaw portion;

a toggle link having a first end pivotally coupled with the first handle adjacent to the first end thereof, a second end extending inwardly of the hollow handle portion of the elongated main handle through a slot therein;

a second handle pivotally secured to the toggle link at an intermediate portion thereof; and an adjustment screw extending inwardly of the hollow handle portion of the elongated main handle, the adjustment screw having an abutting distal end, the abutting distal end cooperating with the second end of the toggle link, the adjustment screw having a cross bar extending therethrough in an orthogonal relationship.

* * * * *